United States Patent [19]

Ahlers

[11] Patent Number: 4,982,768

[45] Date of Patent: Jan. 8, 1991

[54] METHOD AND FILLING ELEMENT FOR DISPENSING LIQUID INTO CONTAINERS

[75] Inventor: Egon Ahlers, Neu-Bamberg, Fed. Rep. of Germany

[73] Assignee: Seitz Enzinger Noll Maschinenbau Aktiengesellschaft, Mannheim, Fed. Rep. of Germany

[21] Appl. No.: 349,714

[22] Filed: May 10, 1989

[30] Foreign Application Priority Data

May 10, 1988 [DE] Fed. Rep. of Germany ..... 3815944
Mar. 22, 1989 [DE] Fed. Rep. of Germany ..... 3909404

[51] Int. Cl.[5] ..... B65B 3/06

[52] U.S. Cl. ..... 141/6; 141/39; 141/4 D; 141/301; 141/302

[58] Field of Search ..... 141/5, 6, 39, 40, 47, 141/48, 49, 63, 301, 302

[56] References Cited

U.S. PATENT DOCUMENTS

| | | | |
|---|---|---|---|
| 1,779,739 | 10/1930 | Kantor et al. | 141/39 |
| 2,605,949 | 8/1952 | Stern | 141/39 |
| 3,263,711 | 8/1966 | Laub | 141/40 |
| 3,380,489 | 4/1968 | Herbst | 141/6 |
| 3,633,635 | 1/1972 | Kaiser | 141/40 |
| 3,804,133 | 4/1974 | Copping | 141/6 |
| 4,102,365 | 7/1978 | Jordan et al. | 141/39 |
| 4,103,721 | 8/1978 | Noguchi | 141/6 |
| 4,386,635 | 6/1983 | Ahlers et al. | 141/6 |
| 4,442,873 | 4/1984 | Yun | 141/39 |
| 4,787,427 | 11/1988 | Bacroix et al. | 141/39 |
| 4,787,428 | 11/1988 | Bacroix et al. | 141/39 |

FOREIGN PATENT DOCUMENTS

| | | | |
|---|---|---|---|
| 1207230 | 12/1965 | Fed. Rep. of Germany . | |
| 2007896 | 8/1971 | Fed. Rep. of Germany | 141/39 |
| 1024217 | 3/1966 | United Kingdom | 141/63 |

*Primary Examiner*—Ernest G. Cusick
*Attorney, Agent, or Firm*—Robert W. Becker & Associates

[57] ABSTRACT

A method and filling element for dispensing a liquid into a bottle or some other container. A filling element is provided with a liquid flow valve and a delivery opening via which, in a filling phase, with the liquid flow valve open, the liquid that is to be dispensed flows into a container that is to be filled through an opening thereof. In a rinsing phase that precedes the filling phase, the interior of the bottle is supplied with a rinsing gas via a tubular member that extends through the container opening into the interior thereof. The rinsing gas is discharged into the container from a gas conduit opening provided at the bottom of the tubular member. This discharge opening is in the form of an annular opening that extends concentrically about the filling element axis. By introducing the rinsing gas into the interior of the container via this annular opening, the quantity of residual air that remains after rinsing is considerably reduced despite a short rinsing time.

15 Claims, 2 Drawing Sheets

VA
34
1a
27'
33
27
21
25
2
29
24
22
23
A
27
32
31
20
30
28
26
6
7
15

METHOD AND FILLING ELEMENT FOR DISPENSING LIQUID INTO CONTAINERS

BACKGROUND OF THE INVENTION

1. Field of the Invention

The present invention relates to a method of dispensing liquid into bottles, cans, or other containers, using a filling element that has a liquid flow valve and a delivery opening, via which, in a filling phase, with said liquid flow valve open, said liquid that is to be dispensed flows into said container that is to be filled through an opening thereof, whereby in a rinsing phase that precedes the filling phase, the interior of the container is supplied with a rinsing gas via a tubular member that extends through the opening of the container into the interior thereof, with the rinsing gas being discharged into the container from a gas conduit opening provided at a bottom end of the tubular member. The present invention also relates to a filling element for filling machines for dispensing a liquid into bottles, cans, or other containers, with the filling element including a liquid flow valve that has a valve body that can be moved back and forth between a position that blocks the liquid flow valve and a position that opens the liquid flow valve, with the filling element being provided in the vicinity of a filling element axis with a delivery opening via which, in a filling phase, with the liquid flow valve open, the liquid that is to be dispensed flows into the container that is to be filled through an opening thereof, and with the filling element also being provided with a tubular member that projects downwardly beyond the filling element and is provided at its bottom, remote from the filling element and in the vicinity of the filling element axis, with an opening of a gas conduit that is formed in the tubular member and is connectable via a control valve arrangement with a source of pressurized rinsing gas.

2. Description of the Prior Art

German Auslegeschrift No. 12 07 230 Hinxlage et al (Holstein & Kappert Maschinenfabrik Phoenix GmbH) dated Dec. 16, 1965, corresponding to British Patent No. 10 24 217-Hinxlage et al (Holstein & Kappert Maschinenfabrik Phoenix GmbH) dated Mar. 30, 1966, discloses a method for dispensing material that is sensitive to air or oxygen. With this heretofore known method, a container that is to be filled is evacuated, is then pressurized with an inert gas, and is finally filed in the filling phase with the liquid material, which as it flows into the container displaces the inert gas located there together with any residual gas that is present into the gas chamber of a supply tank of the filling machine; from time to time, a certain quantity of the air/inert gas mixture that has accumulated in the gas chamber of the supply tank is drawn off and replaced with pure inert gas. The withdrawn air/inert gas mixture is then preferably used to rinse the containers in a rinsing phase that precedes the evacuation and pressurizing. For this purpose, the rinsing gas that is formed from the air/inert gas mixture is supplied to a respective container via a tubular member that projects beyond the bottom of the filling element and that extends through the container opening into the interior of the container, with the bottom of the tubular member being provided with an opening for the discharge of the rinsing gas. During this rinsing (rinsing phase), the interior of the container communicates with the atmosphere via the container opening. The air displaced by the rinsing gas, but also the rinsing gas itself, can thus flow outwardly via the opening of the container. Unfortunately, one of the drawbacks of this heretofore known method is that after the rinsing phase, a relatively great amount of residual air remains in the container.

It is therefore an object of the present invention, in a method for dispensing liquid material into a container, to significantly improve the rinsing or flushing that precedes the actual filling phase in such a way that the rinsing time, and the quantity of residual air that remains in the container, are significantly reduced.

It is a further object of the present invention to provide a filling element that is suitable for carrying out the inventive method.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
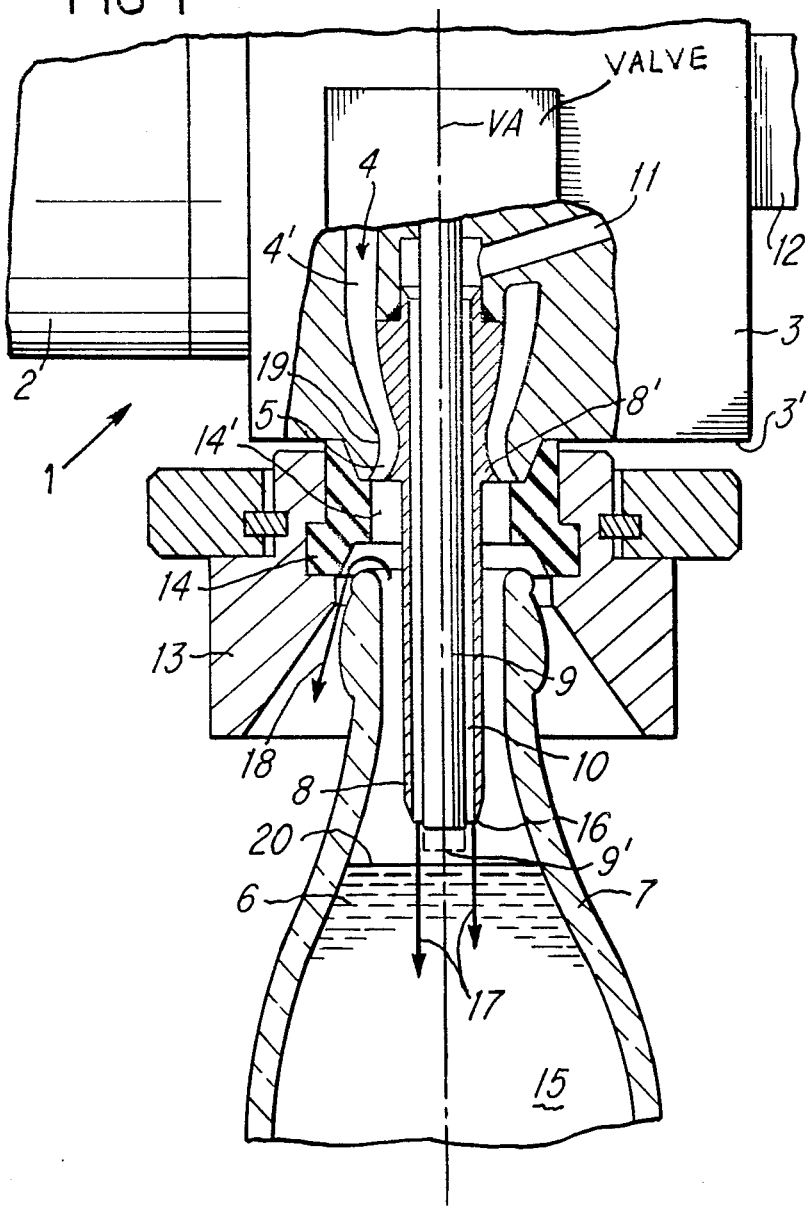
FIG. 1 is a partially cross-sectioned view of a first exemplary embodiment of the inventive filling element, together with a bottle that is disposed below this filling element.

The method and filling element of the present invention are characterized primarily in that the rinsing gas is supplied to the interior of the bottle via a gas conduit opening that is in the form of an annular opening that extends concentrically about the filling element axis.

Pursuant to the method of the present invention, the rinsing gas is discharged at an annular, preferably circular, opening that extends concentrically about the filling element axis. With containers, such as bottles, where the opening of the container is disposed in the vicinity of the vertical axis of the container, the annular opening of the gas conduit also extends about the vertical axis of the container, and in particular opposite the inner surface of the bottom of the container. The rinsing gas is discharged from the annular opening of the tubular member as a relatively well-defined stream and for the most part strikes the inner surface of the bottom of the container over a large surface area and in a region that surrounds the filling element axis, so that at least a considerable quantity of the rinsing gas flows radially outwardly along the inner surface of the bottom of the container to the wall thereof, and from there upwardly, before this rinsing gas, together with the air that it carries along or has displaced, exits at the container opening. Thus, even angles or corners of the interior of the container in the region of the bottom or wall thereof are covered by the rinsing gas.

Pursuant to one preferred specific embodiment of the present invention, the annular opening for the discharge of the rinsing gas is formed by having the tubular member concentrically surround, at a distance, a rod-like element so that there is formed between this rod-like element and the inner surface of the tubular member an annular gas conduit having an annular opening. With this embodiment, it is expedient for the bottom end of the rod-like element to be disposed approximately flush with the bottom end of the tubular member, i.e. the rod-like element preferably does not project beyond the annular opening, or at most extends only slightly beyond the opening, in order to avoid the formation of turbulence in the rinsing gas that is discharged at the annular opening.

The rod-like element can be an element that has no further function. However, the rod-like element can preferably also be a probe, for example a conductance probe, an opto-electric probe, etc., that controls the liquid flow valve of the filling element. By embodying the rod-like element as a probe, it is expedient to embody the liquid flow valve of the filling element as a "foot or retaining valve". Within the context of the present invention, this means that the valve body of the liquid flow valve, which valve body blocks the delivery opening of the filling element when the liquid flow valve is closed and release the filling element for opening the liquid flow valve, is provided directly at the delivery opening in such a way that practically no liquid channels are present at the filling element downstream of the liquid flow valve or the valve body thereof. Since by using such a retaining valve at the end of the filling phase, i.e. after response of the probe and closing of the valve downstream of the closed valve, practically no liquid channels are present from which liquid material can still flow into a container, in other words the level of the liquid material in the container either does not vary at all or varies only insignificantly after response of the probe and closing of the liquid flow valve, it is possible with the use of such a retaining valve to keep the length with which the rod-like element that is embodied as a probe projects beyond the tubular member that serves for supplying the rinsing gas short, thereby assuring an optimum rinsing effect. The gas conduit formed in the tubular member is preferably also used for other purposes, for example as a return gas conduit during the filling phase as well as possibly as a pressurizing gas conduit during a pressurizing of a container preceding the actual filling phase.

Further specific features of the present invention will be described in detail subsequently.

DESCRIPTION OF PREFERRED EMBODIMENTS

Referring now to the drawings in detail, FIG. 1 shows a filling element 1 that, for counterpressure filling, is embodied as a filling element that has no filling tube. Several such filling elements 1 are disposed along the periphery of a rotor 2 (for example an annular liquid channel) that rotates about a vertical axis and is part of a container or bottle filling machine, the other details of which are not illustrated. Provided in the housing 3 of the filling element 1 is a liquid channel 4 that in the illustrated embodiment is provided in the lower portion of the filling element 1, i.e. the housing 3 thereof, as an annular channel (see section 4' of the liquid channel 4) that surrounds the filling element axis VA and in which is provided the customary, non-illustrated liquid flow valve. On the underside of the filling element, i.e. the housing 3, the section 4' of the liquid channel 4 forms the annular delivery opening 5, which similarly surrounds the filling element axis VA and via which, when the liquid flow valve is opened, the liquid material 6 that is to be dispensed flows to the respective bottle 7 that is to be filled.

Projecting beyond the underside 3' of the housing 3 is a tubular member 8 that is open toward the bottom and is coaxial with the filling element axis VA. The tubular member 8 has a circular outer and inner cross-sectional configuration. Disposed in the tubular member 8 is a rod-like element 9, which similarly has a circular outer cross-sectional configuration, and is disposed coaxial with the filling element axis VA. The tubular member 8 concentrically surrounds the rod-like element 9 in such a way that a circular gas conduit 10 is formed between the outer surface of the rod-like element 9 and the inner surface of the tubular member 8. In the interior of the housing 3, the gas conduit 10 opens into a channel 11 that leads to a control valve arrangement 12 via which the channel 11, and hence also the gas conduit 10, are connected not only with a pressurized gas and/or return gas channel that is disposed in the rotor 2, but can also be supplied with a rinsing gas, i.e. with an inert gas/air mixture, whereby $CO_2$ is preferably used as the inert gas.

The arrangement includes a housing 3 for the filling element 1, which has no filling tube, with the housing 3 having an underside for facing a container 7 that is to be filled, with the delivery opening 5 being provided on the underside of the housing 3, and with the tubular member projecting from the delivery opening 5 beyond the underside of the housing 3.

In the illustrated embodiment, the length of the rod-like element 9 is adapted to the length of the tubular member 8 in such a way that the bottom end of the rod-like element 9 is approximately flush with the bottom, open end of the tubular member 8, which is surrounded in the housing 3 not only by the section 4' of the liquid channel 4 but also by the delivery opening 5.

The filling element 1 is furthermore provided with a known centering tulip or bell 13 that has an annular sealing member 14, which concentrically surrounds the tubular member 8 and is spaced therefrom by such a distance that an annular passage 14' is formed between the sealing member 14 and the outer surface of the tubular member 8. When viewed in the direction of flow of the liquid material 6 that is to be dispensed, the annular passage 14' is downstream of the delivery opening 5, and during filling of the bottle 7 forms a continuation or extension of the liquid channel 4.

To fill a bottle 7 with the liquid material 6, an upright bottle 7 is first raised from below against the filling element 1 to such an extent that both the tubular member 8 and the element 9 extend into the interior 15 of the bottle 7 through the mouth or opening thereof; however, the mouth of the bottle 7 is still spaced from the sealing member 14. In this position of the bottle 7 relative to the filling element 1, the interior 15 of the bottle is rinsed with a rinsing or inert gas, for example $CO_2$, for which purpose, via an appropriate disposition of the control valve arrangement 12, the rinsing gas is supplied via the channel 11 to the gas conduit 10, from where it is discharged as a rinsing gas stream into the interior 15 at the bottom of the tubular member 8, i.e. at the annular opening 16 formed between the tubular member 8 and the element 9 (this is indicated by the arrows 17 in FIG. 1). The rinsing ga that enters the interior 15 of the bottle 7 displaces or rinses out the air that is present there. In other words, this air, as well as a rinsing gas, can escape to the outside at the annular gap, which can, for example, have a width of 6 mm, and that is formed between the mouth of the bottle 7 and the underside of the sealing member 14 (this is indicated by the arrow 18 in FIG. 1). Since the rinsing gas is supplied to the interior 15 in the vicinity of the filling element axis VA (arrows 17), it is possible for this rinsing gas to flow through the entire interior 15 of the bottle 7 and to carry along or rinse out any air that is present without any appreciable mixing occurring between the rinsing gas that enters the interior 15 (arrows 17) and the rinsing gas or rinsing gas/air mixture that flows out of the interior 15 in the direction toward the mouth of the bottle 7. By using an annular opening 16 for the discharge of rinsing gas, which opening 16 is formed between the tubular member 8 and the rod-like element 9, a particularly intensive rinsing of the interior 15 of the bottle 7 is possible in a relatively short rinsing time, for example one second with so-called "Euro-bottles", and hence with little use of rinsing gas. In other words, despite an extremely short rinsing time, only an extremely small amount of residual air remains in the interior 15. Pursuant to a realization that forms the basis of the present invention, this can apparently be attributed to the fact that by using the gas conduit 10 that is formed between the tubular member 8 and the rod-like element 9, whereby the rinsing gas is supplied to the gas conduit 10 at, for example, a pressure of about 2.7 bar, this rinsing gas is discharged at the narrow opening 16 as a relatively well-defined stream that due to the annular configuration of the opening 16 nevertheless has a relatively great expansion in a direction perpendicular to the filling element axis VA, and is primarily also uniformly distributed about the filling element axis VA, so that for the greatest part this rinsing gas stream also strikes the inner surface of the base of the bottle, and in particular with a nearly uniform distribution in region of this base of the bottle that surrounds the filling element axis VA. At this inner surface of the base of the bottle, the rinsing gas can then flow unifOrmly radially outwardly and from there in an upward direction, whereby the rinsing gas covers the entire interior 15.

Particularly good results are achieved if the bottom end of the rod-like element 9 is approximately flush with the bottom end of the tubular member 8, as is the case with the embodiment illustrated in FIG. 1. After a bottle 7 has been rinsed, it is filled, whereby a pressurizing phase can precede the actual filling process. For the filling or pressurizing of the bottle 7, this bottle is raised against the filling element 1 to such an extent that the mouth of the bottle 7 rests in a customary manner tightly against the underside of the sealing member 14, the upper side of which in turn is pressed in a sealing manner against the underside of the filling element in a region thereof that surrounds the delivery opening 5. If the bottle 7 is to be pressurized, the appropriate pressuring gas ($CO_2$) is supplied via the channel 11 and the gas conduit 10 after an appropriate disposition of the control valve arrangement 12. To initiate the filling process, the liquid flow valve that is provided in the liquid channel 4 is opened, so that the liquid material 6 that is to be dispensed flows to the interior 15 of the bottle 7. In the region of the delivery opening 5, the liquid channel 4, i.e. the section 4' thereof, is embodied in such a way that at that location there is additionally imparted to the flowing material 6 a movement component that relative to the filling element axis VA is directed radially outwardly. In the illustrated embodiment, this is achieved in that in the region of the delivery opening 5, the annular section 4' of the liquid channel 4 has both an inner and outer annular diameter that increases in the direction of flow of the material 6. For this purpose, in the region of the delivery opening 5, the tubular member 8, in particular that portion of the length thereof that is disposed in the interior of the housing 3, is provided with a portion 8' at which the outer diameter of the tubular member increases downwardly in a conical manner, and which is surrounded by a correspondingly shaped surface 19 of the housing 3 that concentrically extends about the filling element axis VA. The liquid flow valve that is provided in the liquid channel 4 is closed in a customary manner after the level 20 of the liquid material 6 that flows into the bottle 7 has reached the bottom end of the tubular member 8, which bottom end determines the filling height.

Closing of the liquid flow valve can also be controlled by a probe. For this purpose, for example, the rod-like element 9 can be embodied as a probe, in which case the element 9 has a probe portion (for example by embodying the probe as a conductive probe that has a probe contact) that projects slightly beyond the bottom of the tubular member 8, as indicated by the dashed-line portion 9' in FIG. 1. In order not to adversely affect the rinsing that precedes the filling or the pressurizing and filling, it is desirable to keep the axial length of the portion 9' that projects beyond the bottom of the tubular member 8 as small as possible, and in particular in such a way that the probe that forms the rod-like element 9 responds at that level 20 that is just below the open end of the tubular member 8 by such an extent that after the section 4' of the liquid channel 4 has been emptied or drained, the level 20 that the liquid material 6 has reached in the bottle 7 is still far enough from the bottom end of the tubular member 8 that the material 6 does not pass into the gas conduit 10. It is expedient to embody the projecting portion 9' in a streamlined manner.

Figure 2:
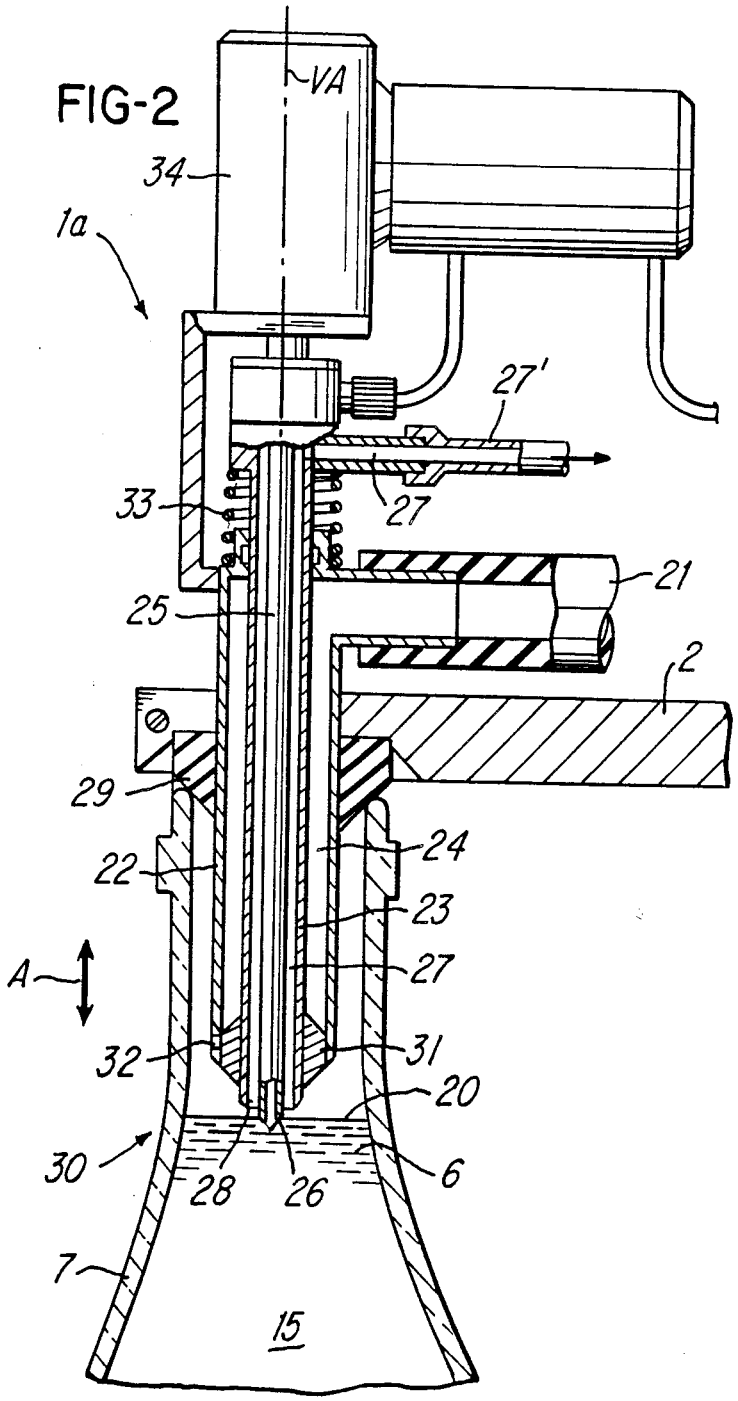
FIG. 2 is a partially cross-sectioned view of a further exemplary embodiment of the inventive filling element.

In a view similar to that of FIG. 1, FIG. 2 illustrates a filling element 1*a* that is distinguished by a particularly straightforward, economical, and sturdy construction, and differs from the filling element 1 in that, for one thing, the filling element 1*a* has a filling tube 22. This filling tube 22, which concentrically extends about the filling element axis VA, is secured directly to the rotor 2 of the container or bottle filling machine, extends beyond the bottom of the rotor 2, and forms at its bottom end the delivery opening for the liquid material 6 that is to be dispensed. The top end of the filling tube 22 extends beyond the rotor 2 and is connected to a hose 21 for the delivery of the liquid material that is to be dispensed. In addition, the filling element 1*a* is provided with a tubular member 23 that corresponds to the tubular member 8 of the filling element 1. The tubular member 23 is concentrically surrounded by the filling tube 22, and forms an annular liquid conduit 24 that is disposed between the outer surface of the tubular member 23 and the inner surface of the filling tube 22, and that is connected to the hose 21. The tubular member 23, which is coaxial with the filling element axis VA, surrounds a rod-like element 25 that corresponds to the element 9 of the filling tube 1. The rod-like element 25 is embodied as a probe, and its bottom end 26, which is provided with a probe contact, extends only slightly beyond the bottom of the tubular member 23, which is open at that location.

At the top end of the filling tube 22, the tubular member 23 is disposed in such a way as to be displaceable by a certain amount in the direction of the filling element axis VA, as indicated by the double arrow A. Furthermore, those portions of the tubular member 23 and the rod-like element 25 that project beyond the top end of the filling tube 22 are mechanically securely connected to one another. At that location, the gas conduit 27, which corresponds to the gas conduit 10 of the filling element 1, and which is formed between the inner surface of the tubular member 23 and the outer surface of the rod-like element 25, is also connected to a hose 27' that leads to a control valve arrangement, for example similar to the control valve arrangement 12 of the filling element 1. As a function of this control valve arrangement, the gas conduit 27 can also be supplied with rinsing gas for rinsing a bottle 7, with this rinsing gas being discharged from the gas conduit 27 at the bottom end of the tubular member 23 at the annular opening 28 that is provided there and that corresponds to the annular opening 16 of the filling element 1. The gas conduit 27 also serves as a return gas conduit during filling with the filling element 1*a*. In place of the sealing member 14, the filling element la is provided directly at the bottom of the rotor 2 with a sealing member 29 that surrounds the filling tube 22. During the rinsing phase, the mouth of a bottle 7 is spaced from the frusto-conical underside of the sealing member 29, with the mouth of the bottle 7 resting sealingly against the underside of the sealing member 29 during the actual filling phase.

As shown in FIG. 2, the filling element 1*a* is provided with a liquid flow valve 30 emodied as a retaining valve, which is formed by a valve body 31 that is secured to the bottom end of the tubular member 23, and that projects radially beyond the remainder of the outer surface of the tubular member 23 and is frusto-conical on its upper and lower sides. The valve body 31 is disposed on the tubular member 23, which is movable in the direction of the filling element axis VA for effecting an opening and closing of the liquid flow valve 30. When the liquid flow valve 30 is closed, the valve body 31 is disposed partially within the filling tube 22, with its peripheral surface resting sealing against the inner surface of the filling tube 22 thereby covering with its peripheral surface openings 32 that are disposed in the wall of the filling tube 22 in the vicinity of the bottom end thereof and are distributed at regular intervals about the filling element axis VA; these openings 32 form the delivery opening. The valve body 31 is preloaded into the upper, closed or rest position by a compression spring 33 that cooperates with the tubular member 23 or the rod-like element 25. Via a magnet arrangement 34 provided at the top of the filling tube 22, in order to open the liquid flow valve 30 the valve body 31, together with the tubular member 23 and the rod-like element 25, are moved downwardly through a prescribed stroke out of their rest position against the effect of the compression spring 33, so that the valve body 31 frees the openings 32, thereby opening the liquid flow valve 30.

Since the valve body 31 is provided directly at the delivery opening of the filling element 1*a*, and in particular in such a way that when the liquid flow valve 30 is closed no portion of the liquid conduit 24 that is disposed upstream of the liquid flow valve has to be drained after the liquid flow valve is closed, i.e. out of which liquid material could still flow or drip into a bottle 7 after the liquid flow valve 30 has been closed, i.e. the level 20 of the liquid material in the bottle 7 no longer changes after response of the probe that forms the rod-like element 25, it is possible to keep the length with which the rod-like element 25 projects beyond the bottom, open end of the tubular member 23 small, so that ideal conditions result with regard to the rinsing, i.e. with regard to the rinsing gas stream that is discharged from the opening 28, even though the rod-like element 25 is embodied as a probe.

Although the present invention was just described in conjunction with two specific embodiments, it is to be understood that alterations and modifications are possible without thereby deviating from the underlying concept of the present invention. For example, it is in particular also possible, with a filling element that has no filling tube, i.e. for example with the filling element 1, to provide a liquid flow valve that is embodied as a foot or retaining valve, and in particular in such a form that upstream of the closed liquid flow valve, practically no section of the liquid conduit is present from which an appreciable quantity of liquid material can flow into a bottle 7 after the liquid flow valve has been closed. With the filling element 1, this retaining valve, which then at that location would also permit the embodiment of the rod-like element 9 as a probe with an extremely short axial length of the portion 9', could be embodied in such a way that the tubular member 8, together with the rod-like element 9, could be displaceable in the housing 3 through a specific stroke in the direction of the filling element axis VA, and in the region of the delivery opening 5 a valve body could be provided on the tubular member 8, with this valve body resting sealingly against a surface that outwardly delimits the section 4' of the liquid flow valve in the region of the delivery opening 5 when the liquid flow valve is closed.

The present invention is, of course, in no way restricted to the specific disclosure of the specification and drawings, but also encompasses any modifications within the scope of the appended claims.

What I claim is:

1. In a method of dispensing liquid into bottles, cans, or other containers, using a filling element that has a filling element axis, a liquid flow valve, an oppositely disposed surface and a delivery opening, via which, in a filling phase, with said liquid flow valve open, said liquid that is to be dispensed flows into a container that is to be filled through an opening thereof, whereby in a rinsing phase that precedes the filling phase, the interior of said container is supplied with a rinsing gas via a tubular member that extends through said opening of said container into the interior thereof, with said rinsing gas being discharged into said container from a gas conduit including an opening provided at a bottom end of said tubular member, comprising the improvement therewith including the step of:

supplying said rinsing gas to the interior of said container via said gas conduit opening in the form of an annular opening that extends concentrically about said filling element axis.

2. A method according to claim 1, which includes the step of providing a rinsing gas that contains a high percentage of inert gas.

3. A method according to claim 2, in which said rinsing gas contains a high percentage of $CO_2$.

4. A method according to claim 1, which includes the step, during said rinsing phase, of providing an annular gap of approximately 6 mm width between said container and said oppositely disposed surface of said filling element to provide communication, in the vicinity of said container opening, between the interior of said container and the atmosphere.

5. A method according to claim 1, which includes the step of carrying out said rinsing phase for approximately one second.

6. A method according to claim 1, in which said gas conduit is formed in said tubular member and is supplied with rinsing gas having a pressure of approximately 2.7 bar.

7. In a filling element for filling machines with a filling phase for dispensing a liquid into bottles, cans, or other containers, with said filling element having a filling element axis and including a liquid flow valve that has a valve body that can be moved back and forth between a position that blocks said liquid flow valve and a position that opens said liquid flow valve, with said filling element being provided, in the vicinity of said filling element axis, with a delivery opening via which, in said filling phase, with said liquid flow valve open, said liquid that is to be dispensed flows into a container that is to be filled through an opening thereof, and with said filling element also being provided with a tubular member that projects downwardly beyond said filling element and that includes an opening of a gas conduit provided at its bottom end, spaced from said filling element and in the vicinity of said filling element axis, said opening of the gas conduit being formed in said tubular member and being connectable via a control valve arrangement with a source of pressurized rinsing gas, comprising the improvement therewith wherein:

said gas conduit opening is in the form of an annular opening that extends concentrically about said filling element axis.

8. A filling element according to claim 7, in which said tubular member has an axis that is coaxial with said filling element axis, and a rod-like element which said tubular member concentrically surrounds and that also has an axis that is coaxial with said filling element axis, with said tubular member being spaced from said rod-like element in such a way that said gas conduit, as an annular gas conduit is formed between said rod-like element and said tubular member.

9. A filling element according to claim 8, in which said rod-like element has a bottom end, spaced from said filling element, that is essentially flush with said bottom end of said tubular member.

10. A filling element according to claim 8, in which said rod-like element is in the form of a probe.

11. A filling element according to claim 7, in which said liquid flow valve is embodied as a retaining valve having a valve body that is disposed in the immediate area of said delivery opening.

12. A filling element according to claim 11, in which said valve body is disposed on said tubular member, which is movable in the direction of said filling element axis for effecting an opening and closing of said liquid flow valve.

13. A filling element according to claim 7, which includes a housing for said filling element, which has no filling tube, with said housing having an underside for facing a container that is to be filled, with said delivery opening being provided on said underside of said housing, and with said tubular member projecting from said delivery opening beyond said underside of said housing.

14. A filling element according to claim 7, which includes a filling tube that concentrically surrounds said tubular member and that has an open bottom end, spaced from said filling element, at which is provided said delivery opening, with said tubular member extending beyond said bottom end of said filling tube.

15. A filling element according to claim 14, in which said delivery opening is formed by a plurality of individual openings provided in said filling tube.

* * * * *